US010895403B2

(12) United States Patent
Hermida Domínguez et al.

(10) Patent No.: US 10,895,403 B2
(45) Date of Patent: Jan. 19, 2021

(54) ELECTRIC HEATING DEVICE FOR HEATING FLUIDS

(71) Applicant: BorgWarner Ludwigsburg GmbH, Ludwigsburg (DE)

(72) Inventors: Xoan Xosé Hermida Domínguez, Gondomar-Pontevedra (ES); Stephen Sweeney, Ballinorig (IE); Cian McCarthy, Dingle (IE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 563 days.

(21) Appl. No.: 15/350,928

(22) Filed: Nov. 14, 2016

(65) Prior Publication Data

US 2017/0138633 A1 May 18, 2017

(30) Foreign Application Priority Data

Nov. 17, 2015 (DE) ..... 10 2015 119 863

(51) Int. Cl.
*F24H 1/14* (2006.01)

(52) U.S. Cl.
CPC ..... *F24H 1/142* (2013.01)

(58) Field of Classification Search
CPC ..... F24H 1/142
USPC ..... 392/480
See application file for complete search history.

(56) References Cited

U.S. PATENT DOCUMENTS 4,178,910 A * 12/1979 Gramer ..... F24S 80/60 126/677
5,930,458 A * 7/1999 Yane ..... F16L 55/115 392/482
2004/0101293 A1* 5/2004 Bissonnette ..... B60S 1/488 392/484
2011/0069943 A1* 3/2011 Luppold ..... B60H 1/2221 392/488
2011/0236004 A1* 9/2011 Bowers ..... F24H 1/106 392/441

(Continued)

FOREIGN PATENT DOCUMENTS

DE 10 2009 038 978 A1 3/2011
DE 10 2012 207 301 A1 11/2013

(Continued)

*Primary Examiner* — Dana Ross
*Assistant Examiner* — Kuangyue Chen
(74) *Attorney, Agent, or Firm* — Bose McKinney & Evans LLP

(57) ABSTRACT

An electric heating device for heating fluids, comprising a housing, inlet and outlet connection pieces arranged at inlet and outlet openings of the housing, respectively, a flow path in the housing through which the fluid to be heated flows leading from the inlet connection piece to the outlet connection piece, and an electric heating unit attached to the housing. The flow path comprises inlet and outlet chambers and at least two flow channels running side by side from the inlet to the outlet chambers. A separating wall separates two flow channels from one another. Each flow channel has an inlet section connected to the inlet chamber and defining an inlet flow direction and an outlet section connected to the outlet chamber and defining an outlet flow direction. The inlet connection piece is oriented in the inlet flow direction and/or the outlet connection piece is oriented in the outlet flow direction.

19 Claims, 2 Drawing Sheets

(56) References Cited

U.S. PATENT DOCUMENTS

| | | | | |
|---|---|---|---|---|
| 2015/0090802 | A1* | 4/2015 | Eckert | F24H 1/009<br>237/12 |
| 2015/0117847 | A1* | 4/2015 | Reinholz | F24H 1/142<br>392/485 |

FOREIGN PATENT DOCUMENTS

| | | | |
|---|---|---|---|
| DE | 10 2012 207 305 | A1 | 11/2013 |
| WO | WO 2010/069355 | A1 | 6/2010 |

* cited by examiner

ELECTRIC HEATING DEVICE FOR HEATING FLUIDS

RELATED APPLICATIONS

This application claims priority to DE 10 2015 119 863.0, filed on Nov. 17, 2015, which is hereby incorporated herein by reference in its entirety.

BACKGROUND

The invention relates to an electric heating device for heating fluids comprising a housing, an inlet connection piece, an outlet connection piece, a flow path through which the fluid to be heated can flow and which leads from the inlet connection piece to the outlet connection piece through the housing. The heating device further comprises at least one electric heating element being attached to a housing wall outside the flow path. The flow path comprises an inlet chamber, an outlet chamber an at least two flow channels running side by side from the inlet chamber to the outlet chamber.

Such heating devices are required, for example, in vehicles in order to heat aqueous fluids, generally mixtures made of water and an anti-freeze agent, such as glycol; in the process the problem arises that relatively large amounts of energy must be introduced as uniformly and quickly as possible into the fluid to be heated. Selective heating of the fluid should be avoided to the extent possible, because this may result in local overheating and disintegration of the fluid. Such heating devices are disclosed in DE 10 2012 207 301 A1 and DE 10 2012 207 305 A1.

In DE 10 2009 038 978 A1 and WO 2010/069355 A1 are disclosed non-generic electric heating devices for heating fluids in vehicles comprising only one flow channel, which extends in several convolutions through a housing.

Feeding the fluid into the known heating devices and separating the flow into several flow channels may lead to a pressure drop or to turbulences so that the fluid does not flow evenly through the flow path. As a result, a non-uniform heating of the fluid can occur.

This disclosure teaches optimizing the flow of the fluid through the heating device to achieve a uniform heating of the fluid.

SUMMARY

A heating device for heating fluids according to this disclosure comprises a housing, an inlet connection piece and an outlet connection piece. The housing has an upper housing part, a lower housing part and housing walls, which are arranged at the upper and/or lower housing part. The inlet connection piece is arranged at an inlet opening of the housing. The outlet connection piece is arranged at an outlet opening of the housing. The heating device comprises a flow path through which the fluid to be heated can flow. The flow path is defined inside the housing and leads from the inlet connection piece to the outlet connection piece. The heating device comprises at least one electric heating unit which is attached to at least one of the housing walls outside of the flow path. The flow path comprises an inlet chamber, an outlet chamber and at least two flow channels running side by side from the inlet chamber to the outlet chamber. At least one of the housing walls is a separating wall, which separates two flow channels from one another. The separating wall can also be denoted as a rib of the housing. The flow path can comprise at least four flow channels. The flow path comprises not more than eight flow channels, in particular not more than six flow channels. The fluid stream entering the heating device through the inlet connection piece and the inlet chamber is divided into at least two fluid streams separated from each other and flowing through the flow channels. After passing through the flow channels, the separate fluid streams are re-united in the outlet chamber and exit the heating device through the outlet connection piece.

Each of the flow channels of the heating device according to this disclosure has an inlet section which is connected to the inlet chamber and defines an inlet flow direction by its extension in flow direction. Each of the flow channels has an outlet section which is connected to the outlet chamber and defines an outlet flow direction by its extension in flow direction. According to this disclosure, the inlet connection piece is oriented in the inlet flow direction and/or the outlet connection piece is oriented in the outlet flow direction. In particular, the flow direction in the inlet connection piece can be parallel to the flow direction in the inlet sections of the flow channels and/or the flow direction in the outlet connection piece can be parallel to the flow direction in the outlet sections of the flow channels. The open cross section of the inlet chamber can decrease continuously towards the inlet connection piece. In other words, the inlet chamber increases its open cross section downstream of the inlet connection piece. The inlet chamber can therefore act as a diffuser. The open cross section of the outlet chamber can decrease continuously towards the outlet connection piece. Hence, the outlet chamber can act as a nozzle.

Embodiments incorporating this disclosure may provide the following advantages:

- A heating device designed according to this disclosure has a reduced flow resistance. The pressure drop in the flow path is reduced significantly.
- The fluid stream can stream very smoothly through the heating device.
- The velocity of the fluid flow in the heating device is decreased, in particular by the design of the inlet chamber and/or the outlet chamber.
- The reduced flow speed leads to a uniform separation of the fluid into the separated flow channels.
- The heating of the fluid is more uniform.
- The total degree of efficiency of the heating device is increased.
- The uniform heating reduces the occurrence of steam bubbles in the heating device. If nevertheless steam bubbles occur, they can easily flow out through the outlet connection piece.

In the flow path, especially in the inlet chamber, sharp edges should be avoided, because they could lead to turbulences. The increase of the open cross section of the inlet chamber can be a linear increase but also can be designed according to any other algebraic function. The open cross section of the outlet chamber can decrease accordingly.

The flow channels can each have an S-shaped form and can run side by side in a meandering way, but they also can run parallel to each other, in particular along their entire length. The inlet sections and/or the outlet sections of the flow channels can run straight. Particularly, the flow channels can run straight or each comprises not more than one curved section. Flow channels with one curved section run U-shaped from the inlet chamber to the outlet chamber. Flow channels comprising a curved section have different length. In particular, one of the flow channels can be shorter and can have a bigger open cross section than another flow channel. The open cross section of one flow channel can remain constant along its entire length. Two flow channels are separated along their entire length by a separating wall.

According to a further embodiment of this disclosure, the housing can comprise a base wall which limits the flow channels. The base wall extends transversely to the separating wall. An electric heating unit can be attached to the base wall, in particular to its side facing away from the flow channels. The base wall can be planar and the flow channels can run parallel thereto. The heating unit can also be planar. At least one of the walls separating the flow channels extends transversely to the base wall, in particular perpendicular to the base wall. The width of the separating wall can decrease with increasing distance from the base wall. This can improve the heat transfer to the fluid. The base wall and the separating walls can be heated by the electric heating unit. The upper and lower housing part both can have a base wall. The base wall of the lower housing part and/or the base wall of the upper part can be heated. One of the base walls can be heated by the electric heating unit. The other base wall can be heated by exhaust heat of a control unit arranged in or attached to the housing. The base wall of the lower housing part can be arranged parallel to the base wall of the upper housing part. In particular, a separating wall extending from the lower housing part faces a separating wall extending from the upper housing part so that these two separating walls together separate one flow channel from another flow channel. Small gaps between these two walls, through which little leakage between the two flow channels can occur, are not of importance so that low manufacturing tolerances with respect to the separating walls are not necessary. A section of the inlet chamber, in particular a section of the inlet chamber adjacent to the flow channels, can be limited by a section of the base wall. The base wall limiting a section of the inlet chamber and the inlet connection piece can be arranged at the same housing part. In the section of the inlet chamber being limited by the base wall, the flow path is not yet separated by separating walls, so that the fluid stream has more time to equalize before entering the inlet sections of the separate flow channels. The open cross section of the inlet chamber in the section being limited by the base wall can be constant.

In a further embodiment of this disclosure, in which the flow channels are U-shaped, the length of the flow channels is different. To prevent a non-uniform heating of the fluid, the open cross sections of the flow channels can differ in size, so that the shorter flow channels can have a bigger open cross section than the longer flow channels. Different open cross sections of the flow channels can help equalize different heating zones, in which the heating power differs. A lower heating power can be equalized by a longer residence time of the fluid in the respective flow channel.

According to a further embodiment, the inlet chamber and/or the outlet chamber can comprise a tapering section. The tapering section can comprise a planar and/or cone-shaped surface. The tapering section comprises a surface which is inclined to the flow direction in the flow path. The open cross section of the inlet chamber can decrease continuously towards the inlet connection piece. The inlet chamber—viewed transversely to the base wall—can decrease its width towards the inlet connection piece. The inlet chamber—viewed along the base wall and transversely to the flow direction—can increase its height towards the inlet connection piece. The open cross section of the outlet chamber can decrease continuously towards the outlet connection piece. The outlet chamber—viewed transversely to the base wall—can decrease its width towards the outlet connection piece. The outlet chamber—viewed along the base wall and transversely to the flow direction—can increase its height towards the outlet connection piece. When the inlet or outlet chamber is viewed transversely to the base wall, in particular perpendicular to the base wall and transversely to the flow direction, its width can be seen, which width is measured transversely to the flow direction. When the inlet or outlet chamber is viewed along the base wall, in particular parallel thereto, and transversely to the flow direction, its height can be seen, which height is also measured transversely to the flow direction. Although the height of the inlet chamber increases towards the inlet connection piece, the width of the inlet chamber can decrease towards the inlet connection piece to such an extent that the total open cross section of the inlet chamber decreases towards the inlet connection piece. The inlet chamber can have a length measured in flow direction, which is longer than the length of the outlet chamber. The tapering section of the inlet chamber can have approximately the same length as the tapering section of the outlet chamber. The tapering section of the inlet chamber can be longer than one third of the total length of the inlet chamber, in particular can have approximately half the length of the total length of the inlet chamber.

In a further embodiment, the inlet connection piece—viewed transversely to the base wall—can be centered to the inlet sections of the flow channels. This can help to achieve a symmetric and uniform inflow of the fluid into the flow channels. The outlet connection piece—viewed transversely to one of the base walls—can be oriented to the outlet section of an outer flow channel which is adjacent to an outer side wall, which connects the base wall of the lower housing part and the base wall of the upper housing part. This can make it easier that steam bubbles, which nevertheless accrued in the flow channels during heating of the fluid, can easily flow out of the heating device and do not obstruct the flow path in the outlet chamber. The inlet connection piece and the outlet connection piece can both be arranged at the upper housing part or can be both arranged at the lower housing part.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
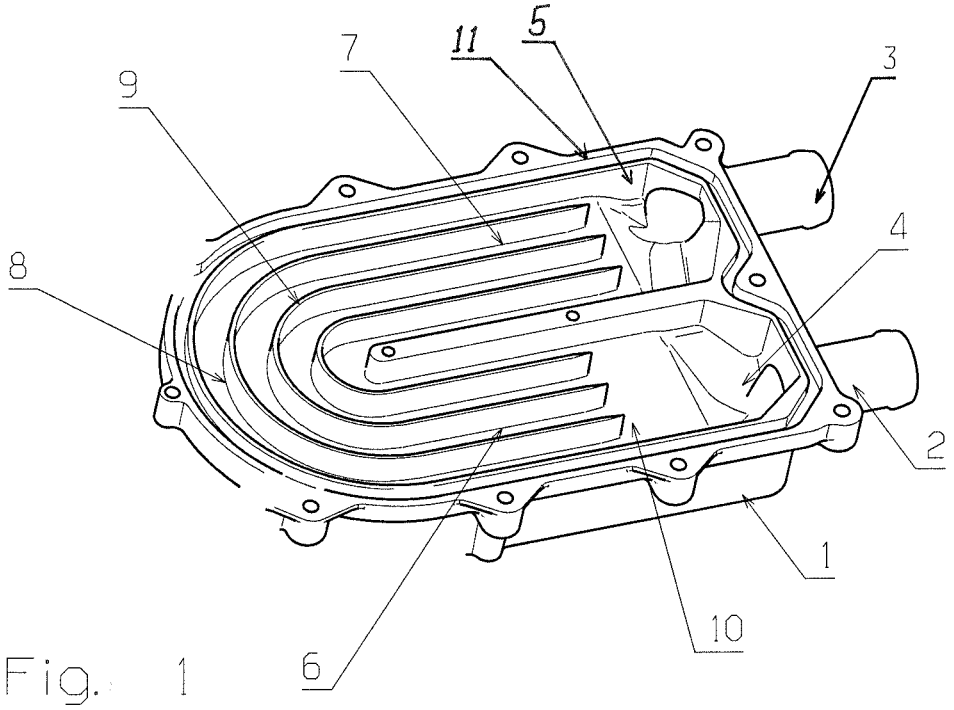
FIG. 1 shows a perspective view of a lower housing part of an electric heating device according to this disclosure.

The heating device partly illustrated in FIGS. 1 to 4 is used to heat aqueous fluids in vehicles, in particular mixtures made of water and antifreeze agent, such as glycol. The electric heating device has a housing, which comprises a lower housing part 1 and an upper housing part (not shown). An inlet connection piece 2 is arranged at an inlet opening of the lower housing part 1. An outlet connection piece 3 is arranged at an outlet opening of the lower housing part 1. A flow path is defined inside the housing and leads from the inlet connection piece 2 to the outlet connection piece 3. The fluid to be heated can flow through the flow path. The flow path comprises an inlet chamber 4, an outlet chamber 5 and four flow channels 8 running side by side and parallel to each other from the inlet chamber 4 to the outlet chamber 5. Each flow channel 8 has an inlet section 6 being connected to the inlet chamber 4. Each flow channel 8 has an outlet section 7, which is connected to the outlet chamber 5. The lower housing part 1 has three ribs or separating walls 9, each of which separates two flow channels 8 from one another. In FIG. 1, the flow channels 8 are U-shaped and have a straight inlet section 6 and a straight outlet section 7 connected by a curved section. The lengths of the four flow channels 8 in FIG. 1 are therefore different.

The inlet sections 6 define an inlet flow direction which extends along the straight inlet section 6 of the flow channel 8. The inlet connection piece 2 is oriented in the inlet flow direction, so that the flow direction in the inlet connection piece 2 is parallel to the flow direction in the inlet sections 6. The outlet sections 7 define an outlet flow direction, which is parallel to the inlet flow direction. The outlet connection piece 3 is oriented in the outlet flow direction, so that the flow in the outlet connection piece 3 flows parallel to the flow in the outlet sections 7.

The lower housing part 1 comprises a base wall 10, which limits the flow channels 8 and extends perpendicular to the separating walls 9. The base wall 10 is planar and the flow channels 8 run parallel thereto. The electric heating device comprises an electric heating unit (not shown), which is attached to the back side of the base wall 10 and which can heat the base wall 10 from the underside. The heat from the heating unit is conducted through the base wall 10 and conducted by the separating walls 9 to the flow channels 8, in which the fluid to be heated can flow. The separating walls 9 have a width, which decreases with increasing distance from the base wall 10. The heating unit does not come into contact with the aqueous fluid to be heated, because it is arranged outside the flow path. In FIG. 1 is shown that the inlet connection piece 2 is arranged on the opposite side of a plane defined by the base wall 10 with respect to the flow channels 8. The outlet connection piece 3 and the flow channels 8 are arranged on opposite sides of a plane defined by the base wall 10.

To form a closed flow path in the sections of the inlet chamber 4, the flow channels 8 and the outlet chamber 5, an upper housing part (not shown) is provided onto the lower housing part 1. The upper housing part also has a base wall, which—after assembly—covers the lower housing part 1 and extends parallel to the base wall 10 of the lower housing part 1. The housing further has an outer side wall 11, which connects the base wall 10 of the lower housing part 1 and the base wall of the upper housing part (not shown). A seal can be arranged on the outer side wall 11 between the upper and lower housing part. The base wall of the upper housing part can contact the separating walls 9 of the lower housing part 1. In an alternative, the upper housing part can also comprise separating walls which are designed mirror-symmetrically to the separating walls 9 of the lower housing part 1, so that the chamber 4, 5 and the flow channels 8 are partly arranged in the upper and lower housing parts.

Figure 2:
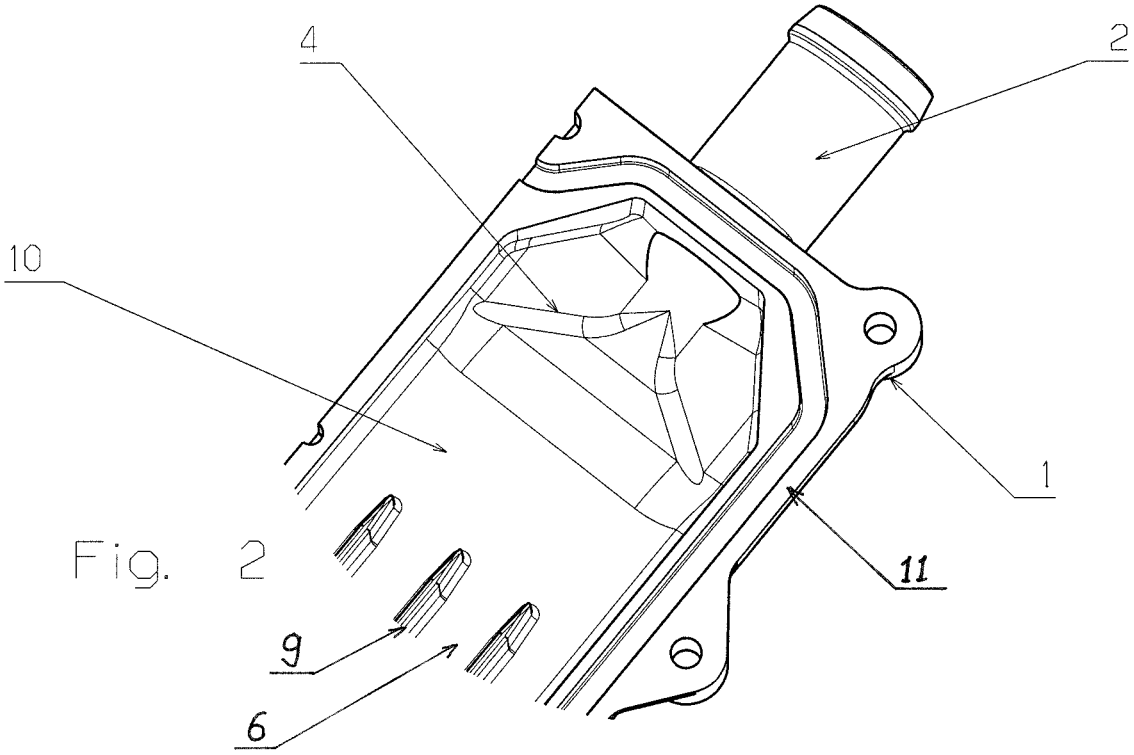
FIG. 2 shows a perspective view of an inlet area of another embodiment of a lower housing part.
Figure 3:
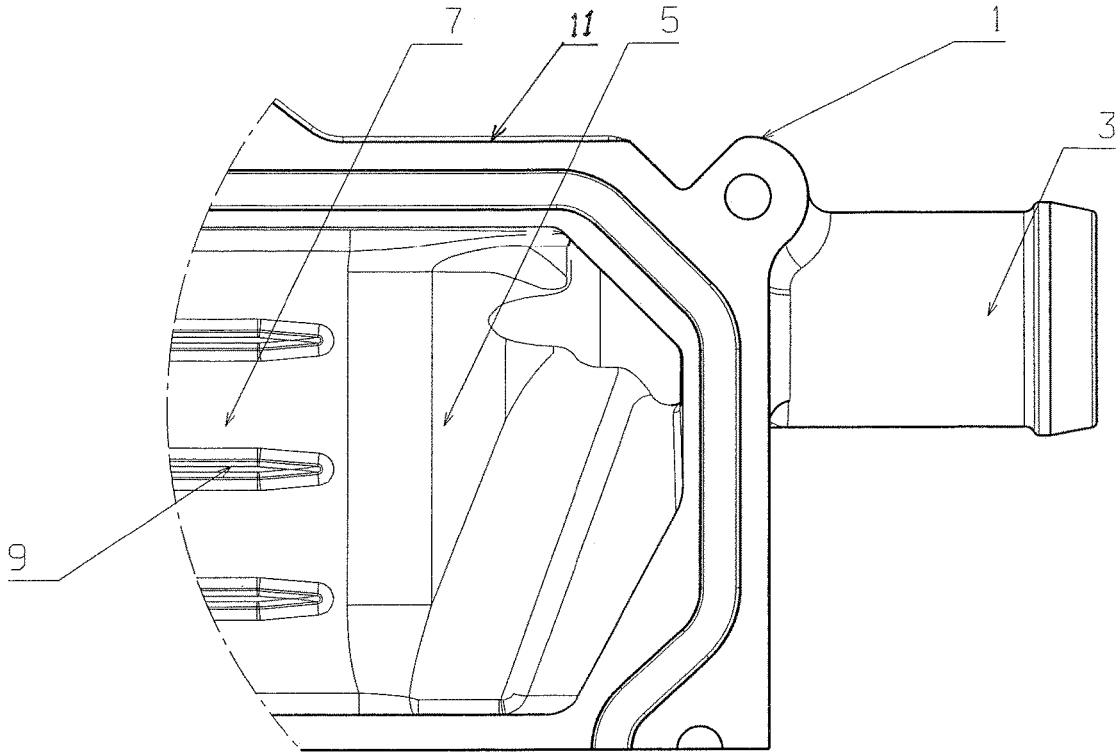
FIG. 3 shows a top view of an outlet area of the lower housing part of FIG. 2.
Figure 4:
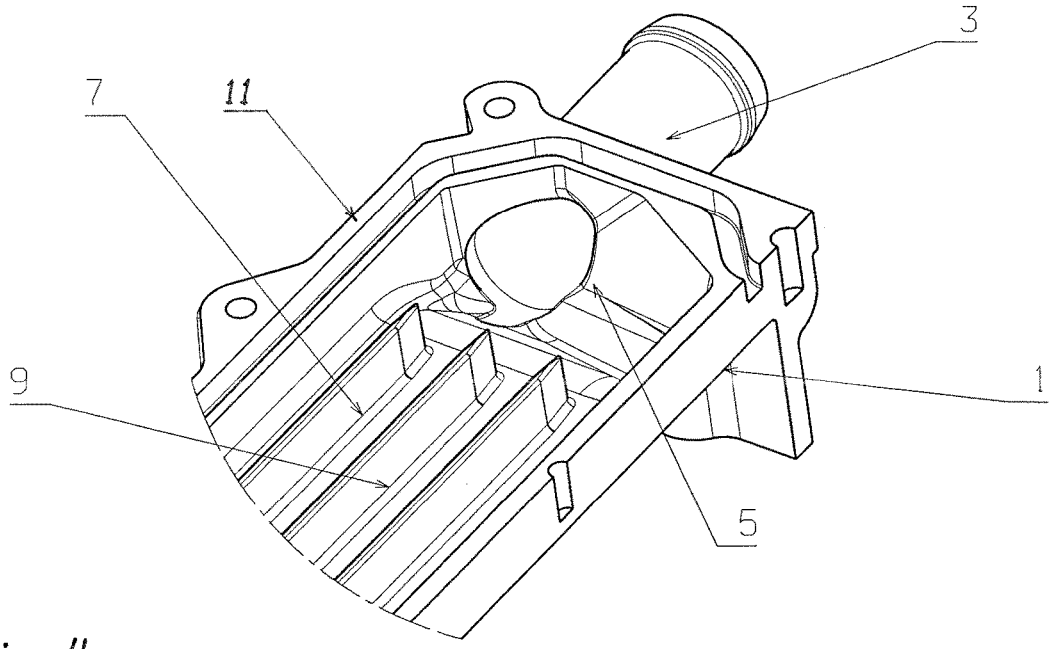
FIG. 4 shows a perspective view of FIG. 3.

In FIGS. 2, 3 and 4, a further embodiment of an electric heating device is shown, which differs from the embodiment shown in FIG. 1 in that four flow channels 8 run straight and parallel along their entire lengths. Identical and corresponding parts are denoted with agreeing reference numerals, so that a repeated description can be omitted.

The inlet connection piece 2 is centered to the inlet sections 6 of the flow channels 8 when the lower housing part 1 is viewed perpendicular to the base wall 10, see in particular FIG. 2. The outlet connection piece 3 is oriented to the outlet section 7 of an outer flow channel 8, which is adjacent to the outer side wall 11, when the lower housing part 1 is viewed perpendicular to the base wall 10, see in particular FIGS. 3 and 4.

The inlet chamber 4 and the outlet chamber 5 both have tapering sections, each of which is formed by a surface, which is inclined to the flow direction. The length of the tapering section of the inlet chamber 4 corresponds approximately to the length of the tapering section of the outlet chamber 5. The open cross section of the inlet chamber 4 decreases continuously towards the inlet connection piece 2. A section of the inlet chamber 4 adjacent to the inlet sections 6 of the flow channels 8 is limited by a section of the planar base wall 10. In FIGS. 1 and 2, the reference line leading to reference numeral 4 begins in the first section of the inlet chamber having the changing open cross section, and the reference line leading to reference numeral 10 begins in the second section of the inlet chamber being limited by a section of the base wall 10 and having a constant open cross section. In other words, the open cross section of the flow path is constant in the inlet connection piece 2, then increases in the first section of the inlet chamber 4 and then remains constant again in the second section of the inlet chamber 4 which is limited by the base wall 10. The open cross section of the following flow path is constant throughout the flow channels 8. Thereafter, the open cross section of the outlet chamber 5 decreases continuously towards the outlet connection piece 3. When viewed perpendicular to the base wall 10, the inlet chamber 4 decreases its width towards the inlet connection piece 2 and the outlet chamber 5 decreases its width towards the outlet connection piece 3. When viewed parallel to the base wall 10 and transversely to the flow direction, the inlet chamber 4 increases its height towards the inlet connection piece 2 and the outlet chamber 5 increases its height towards the outlet connection piece 3.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SIGNS

1 Lower housing part
2 Inlet connection piece
3 Outlet connection piece
4 Inlet chamber
5 Outlet chamber
6 Inlet sections of flow channels
7 Outlet sections of flow channels
8 Flow channels
9 Separating walls
10 Base wall
11 Outer side wall

What is claimed is:

1. An electric heating device for heating fluids, comprising:

a housing having an upper housing part, a lower housing part and housing walls arranged on the upper and lower housing parts, the housing walls including two base walls wherein the upper housing part and the lower housing part each define one of the base walls;

an inlet connection piece arranged at an inlet opening of the housing and an outlet connection piece arranged at an outlet opening of the housing;

a flow path through which the fluid to be heated can flow and which is disposed inside the housing and leads from the inlet connection piece to the outlet connection piece;

an electric heating unit attached to at least one of the housing walls outside of the flow path;

wherein the flow path comprises an inlet chamber, an outlet chamber and at least two flow channels running side by side from the inlet chamber to the outlet chamber;

wherein each of the at least two flow channels starts at the inlet chamber and ends at the outlet chamber;

wherein at least one of the housing walls is a separating wall that separates two side-by-side channels of the at least two flow channels from one another wherein opposite sides of the separating wall defines a portion of each of the two side-by-side channels;

wherein each of the at least two flow channels has an inlet section connected to the inlet chamber and defining an inlet flow direction and each of the at least two flow channels has an outlet section connected to the outlet chamber and defining an outlet flow direction and wherein each of the at least two flow channels are disposed between and partially defined by the base walls on the upper and lower housing parts;

wherein the inlet connection piece is oriented in the inlet flow direction and/or the outlet connection piece is oriented in the outlet and wherein the housing walls arranged on the upper and lower housing parts define at least one gap between the housing walls permitting fluid leakage from one of the side-by-side fluid channels to the other side-by-side fluid channel.

2. The heating device according to claim 1, wherein the base walls extend transversely to the separating wall.

3. The heating device according to claim 2, wherein the base walls are planar and the at least two flow channels run parallel thereto.

4. The heating device according to claim 3, wherein the inlet connection piece and the at least two flow channels are arranged on opposite sides of a plane defined by one of the base walls.

5. The heating device according to claim 3, wherein the outlet connection piece and the at least two flow channels are arranged on opposite sides of a plane defined by one of the base walls.

6. The heating device according to claim 2, wherein, when viewed transversely to the base walls, the inlet connection piece is centered with the inlet sections of the at least two flow channels.

7. The heating device according to claim 2, wherein the separating wall projects from one of the base walls toward the other base wall and the at least one gap permitting fluid leakage from one of the side-by-side fluid channels to the other side-by-side fluid channel is disposed between the separating wall and the other base wall.

8. The heating device according to claim 1, wherein, when viewed transversely to one of the base walls, the outlet connection piece is oriented to the outlet section of an outer one of the at least two flow channels, which is adjacent to an outer side wall, which connects the base wall of the lower housing part and the base wall of the upper housing part.

9. The heating device according to claim 2, wherein a section of the inlet chamber adjacent to the at least two flow channels is limited by a section of each of the base walls.

10. The heating device according to claim 1, wherein the inlet chamber and/or the outlet chamber comprises a tapering section.

11. The heating device according to claim 1, wherein the open cross section of the inlet chamber decreases continuously towards the inlet connection piece.

12. The heating device according to claim 11, wherein, when viewed transversely to the base walls, the inlet chamber has a width that decreases towards the inlet connection piece.

13. The heating device according to claim 11, wherein, when viewed transversely to the flow direction and along the base walls, the inlet chamber has a height that increases towards the inlet connection piece.

14. The heating device according to claim 1, wherein the open cross section of the outlet chamber decreases continuously towards the outlet connection piece.

15. The heating device according to claim 14, wherein, when viewed transversely to the base walls, the outlet chamber has a width that decreases towards the outlet connection piece.

16. The heating device according to claim 14, wherein, when viewed transversely to the flow direction and along the base walls, the outlet chamber has a height that increases towards the outlet connection piece.

17. The heating device according to according to claim 2, wherein the separating wall projects from a first one of the base walls and has a width which decreases with increasing distance from the first base wall and wherein the electric heating unit is attached to the first base wall.

18. The heating device according to claim 1, wherein the separating wall starts at the inlet chamber and ends at the outlet chamber.

19. An electric heating device for heating fluids, comprising:

a housing having an upper housing part, a lower housing part and housing walls arranged on the upper and lower housing parts, the housing walls including two base walls wherein the upper housing part and the lower housing part each define one of the base walls;

an inlet connection piece arranged at an inlet opening of the housing and an outlet connection piece arranged at an outlet opening of the housing;

a flow path through which the fluid to be heated can flow and which is defined inside the housing and leads from the inlet connection piece to the outlet connection piece;

an electric heating unit attached to at least one of the housing walls outside of the flow path;

wherein the flow path comprises an inlet chamber, an outlet chamber and at least two flow channels running side by side from the inlet chamber to the outlet chamber;

wherein the base walls define opposing surfaces of each of the at least two flow channels;

wherein at least one of the housing walls is a separating wall that extends transversely to the base wall and separates two adjacent flow channels of the at least two flow channels from one another with opposite sides of the separating wall defining a portion of each of the two adjacent flow channels;

wherein each of the at least two flow channels has an inlet section connected to the inlet chamber and defining an inlet flow direction and each of the at least two flow channels has an outlet section connected to the outlet chamber and defining an outlet flow direction;

wherein each of the two adjacent flow channels define a curved path and the two adjacent flow channels define different lengths from the inlet chamber to the outlet chamber and a shorter length channel of the two adjacent flow channels has a larger open cross sectional area than a longer length channel of the two adjacent flow channels; and wherein the inlet connection piece is oriented in the inlet flow direction and/or the outlet connection piece is oriented in the outlet flow direction.

* * * * *